US005561861A

United States Patent [19]

Lopez et al.

[11] Patent Number: 5,561,861

[45] Date of Patent: Oct. 8, 1996

[54] DISPOSABLE SURGICAL GOWN WITH SINGLE-PLY KNITTED WRIST CUFFS AND METHOD OF PRODUCING SAME

[75] Inventors: Francisco G. Lopez, El Paso, Tex.; Roscoe M. Farrell, Pittsboro; Melvin Euliss, Burlington, both of N.C.

[73] Assignee: Johnson & Johnson Medical, Inc., El Paso, Tex.

[21] Appl. No.: 101,360

[22] Filed: Aug. 3, 1993

[51] Int. Cl.[6] ..... A41B 7/00

[52] U.S. Cl. ..... 2/123; 66/172 E; 128/846

[58] Field of Search ..... 66/173, 172 E, 66/172 R, 174, 171; 2/114, 123, 60, 51

[56] References Cited

U.S. PATENT DOCUMENTS

| | | | |
|---|---|---|---|
| 2,414,845 | 1/1947 | Wulsin . | |
| 2,668,294 | 2/1954 | Gilpin | 2/114 |
| 2,702,998 | 3/1955 | Purcell | 66/172 E |
| 3,011,172 | 12/1961 | Tames . | |
| 3,429,433 | 2/1969 | Holt . | |
| 3,729,747 | 5/1973 | Belkin | 2/114 |
| 4,027,667 | 6/1977 | Swallow et al. | 66/172 E |
| 4,034,580 | 7/1977 | Holder | 66/172 E |
| 4,150,554 | 4/1979 | Cassidy, Sr. . | |
| 4,397,161 | 8/1983 | Cheseboro, Jr. et al. | 66/172 E |
| 4,752,972 | 6/1988 | Neckerman et al. | 2/123 |

OTHER PUBLICATIONS

Knitted Fabric Technology.

Work glove, American Glove Co., Lyerly, GA, Style 2PN–62MIE, with single ply elastic rib wrist cuff.

*Primary Examiner*—Jessica J. Harrison
*Assistant Examiner*—Michael O'Neill
*Attorney, Agent, or Firm*—Shefte, Pinckney & Sawyer

[57] ABSTRACT

Material and fabrication costs associated with disposable surgical gowns and like medical garments are significantly reduced by utilizing a circularly-knitted tubular fabric cuff formed predominantly of a single-ply knitted construction with a small annular turned welt presenting a finished outer cuff edge. The circularly-knitted fabric of each cuff comprises a main body having plural body yarns and an elastic yarn formed in needle loops in circumferential courses and axial wales, the turned welt of each cuff comprising a welt beginning course connected to a welt ending course with a plurality of intervening courses therebetween. Preferably, each cuff's main body has an annular region adjacent the welt having courses of alternating needle loops and yarn floats and courses entirely of successive needle loops and an adjacent annular region having courses of alternating needle loops and tuck stitches and courses entirely of successive needle loops. Fabric courses may be formed alternately of S-twist and Z-twist yarns to provide a flattening effect on the fabric tube.

14 Claims, 5 Drawing Sheets

DISPOSABLE SURGICAL GOWN WITH SINGLE-PLY KNITTED WRIST CUFFS AND METHOD OF PRODUCING SAME

BACKGROUND OF THE INVENTION

The present invention relates generally to protective body garments such as commonly worn by surgical and other medical personnel, especially disposable surgical gowns, and relates more particularly to the provision of a single-ply circularly-knitted cuff for use in such garments to encircle body openings in the garment, such as the wrist openings at the end of the sleeves of a surgical gown.

A is well known, it is of paramount importance in the performance of surgical and many other medical procedures that sterile conditions be maintained and, toward this end, physicians, nurses and other medical personnel participating in or present during such procedures virtually always wear sterilized protective body garments over substantially the entirety of the person's body, along with taking other precautions and sterility measures, to minimize the risk of transmitting bacteria, germs, diseases and the like between the patient and the medical personnel.

One common protective garment of this type is a surgical gown worn about the upper body and typically comprising a torso-encircling main body portion, normally opening along its back panel with tie strings or the like to close the garment about the wearer's body, and a pair of sleeves extending from opposite sides of the main body portion for covering the wearer's arm.

For enhanced maintenance of sterility, it is desirable to provide such surgical gowns with cuff portions at the ends of the sleeves to conform to the wearer's wrists. A knitted cuff, commonly of a tubular circularly-knitted fabric, is preferable for this purpose.

One on-going problem continually facing the medical industry is how to accomplish the overriding objective of continuing to improve and advance the sterility of surgical and other medical environments while at the same time avoiding or at least minimizing unnecessary increases in medical and health care costs. Toward this end, the medical industry has turned in recent years to the use of disposable one-time or limited use surgical gowns which can be manufactured inexpensively from non-woven textile materials and eliminate the necessity and expense attendant to other garments of cleaning and sterilizing the garments after each use.

While disposable surgical gowns and like protective medical garments have proved to be an effective cost-saving measure, concern has developed that the material and fabrication costs associated with the provision of knitted cuffs on such garments is disproportionately high in relation to the remainder of the garments.

Typically, the knitted cuff on disposable surgical gowns is formed of a circularly-knitted rib-type textile fabric which is fabricated in extended lengths and made into individual cuffs during the gown fabrication process by cutting the circular fabric to discrete lengths, everting the cut fabric portion upon itself into a double-ply cuff to provide a finished edge at the fold line thusly produced, and then sewing the adjacent cut edges to the end of a sleeve.

Although a two-ply cuff is undesirable in that the dual thickness of fabric and the labor involved in the cutting and sewing process contributes to increased costs in the garment, the two-ply cuff is considered necessary from a functional standpoint to provide a finished end edge to the cuff so that it will not unravel and potentially shed fibers that may, for example, find their way into a surgical site.

SUMMARY OF THE INVENTION

Accordingly, it is an object of the present invention to provide an improved knitted cuff which is suitable for use in disposable surgical gowns and like protective medical garments and which is largely of a single-ply construction to reduce the attendant costs of manufacturing such garments. A further object of the present invention is to provide an improved cuff which will additionally reduce and simplify inventory and labor costs and procedures involved in the fabrication of such garments. The present invention also seeks to provide an improved method of fabricating disposable surgical gowns and the like by the use of the improved cuff.

Basically, the cuff of the present invention may be utilized in substantially any protective body garment of the type commonly worn by surgical and other medical personnel which comprises a main body for covering a portion of the wearer's body and an opening in the main body for extension therethrough of an extremity of the wearer's body. Typically and preferably, the cuff of the present invention will be utilized in disposable surgical gowns of the type having a main body robe portion for covering the wearer's torso and arms, with the robe portion having a pair of arm sleeves terminating at wrist openings therein for extension respectively therethrough of the wearer's arms. However, the invention is equally applicable as well to cuffs on other medical garments, e.g., on the leg portions of lower body medical garments.

In any case, a cuff according to the present invention is affixed to the garment body in surrounding relation to the opening or openings thereof. In accordance with the present invention, each such cuff basically comprises a circularly-knitted fabric tube having a main cuff body potion of a single-ply knitted construction terminating at an outer end of the cuff in an integral turned welt forming a finished cuff edge.

In the preferred embodiment, the circularly-knitted fabric tube of each cuff comprises a plurality of body yarns and an elastic yarn formed in needle loops extending in circumferential courses and axial wales. The turned welt of each cuff comprises a welt beginning course, a welt ending course, and a plurality of intervening courses, the welt beginning and ending courses being connected with one another by a set of connecting needle loops formed in selected spaced wales, e.g., every fourth wale, and the intervening courses comprising needle loops formed only in wales other than the selected spaced wales and in yarn floats across such wales.

The main cuff body portion preferably includes at least selected courses which have needle loops formed in every wale and, thus, the main cuff body portion is of a greater diameter than the turned welt of the cuff as a result of the absence of needle loops in the selected spaced wales of the welt's intervening courses, thereby forming the cuff of a tapered configuration.

For example, in the preferred embodiment, the main cuff body portion of each cuff comprises a first annular region adjacent the turned welt having courses formed of alternating needle loops and yarn floats and courses formed entirely of successive needle loops appearing in every wale, and a second annular region adjacent the first annular region having courses formed of alternating needle loops and tuck stitches and courses formed entirely of successive needle loops appearing in every wale.

It is preferred to form alternating and intervening courses of the circularly-knitted fabric tube with S-twist and Z-twist yarns so as to cooperatively provide a flattening effect on the fabric tube.

According to another aspect of the present invention, the single-ply cuff as described above enables a unique method for fabricating disposable and like surgical gowns to be carried out without the heretofore conventional necessity of cutting and folding a cuff preparatory to sewing to a gown. More specifically, in accordance with the present method, surgical gowns are fabricated by initially fabricating main body robe portions for the surgical gowns, with each robe portion having a pair of arm sleeves terminating at respective wrist openings therein. Then, a plurality of discrete individual annular cuff blanks are knitted for the surgical gowns on a circular knitting machine. Basically, the knitting of each blank comprises the steps of forming on the circular knitting machine an annular turned welt presenting a finished cuff edge, knitting integrally to the welt an annular main cuff body portion of a single-ply knitted construction, and then discharging from the knitting machine the integral welt and main cuff body portion as a discrete complete cuff blank upon completion of the knitting of the main cuff body portion. Such cuff blanks require no cutting, folding or other structural modification and can be easily inventoried in such form until needed for incorporation in the surgical gown, without any such intervening cutting, folding or other structural modification of the cuff blanks. The fabrication of the surgical gown is completed by affixing the main cuff body portion of one respective cuff blank to each sleeve of each robe portion in surrounding relation to the sleeve's wrist opening.

DETAILED DESCRIPTION OF THE PREFERRED EMBODIMENT

Figure 1:
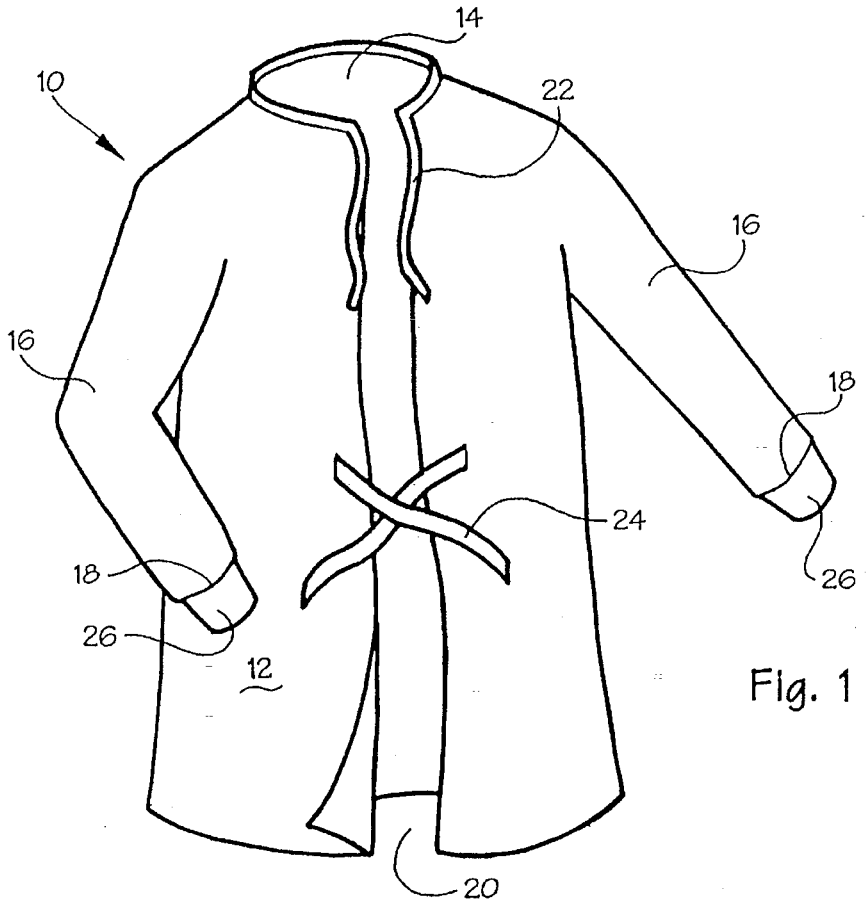
FIG. 1 is a perspective view of a surgical gown having cuffs in accordance with the present invention.

Referring now to the accompanying drawings and initially to FIG. 1, a surgical gown of the disposable type in which the cuff of the present invention is preferably embodied is indicated generally at 10. Of course, as those persons skilled in the art will recognize and understand, the cuff of the present invention is equally suitable for use in reusable surgical gowns as well as in various other medical and like use garments, e.g., as ankle cuffs on surgical pants, and accordingly it is to be understood that the present invention is applicable to all such medical and like garments and is not limited to disposable surgical gowns, the description herein being provided solely as one illustrative and exemplary embodiment of the present invention.

The gown 10 basically includes a main body robe portion 12 sewn of a plurality of fabric panels (not indicated) into the shape of a human's upper body for protectively covering the wearer's torso and arms. A neck opening 14 is formed at the upper end of the robe portion 12 and the robe portion 12 includes a pair of sleeves 16 extending outwardly from opposite sides and terminating at wrist openings 18. The facilitate placement of the gown 10 onto, and removal of the gown from, the wearer's body, a lengthwise slit-like opening 20 extends downwardly from the neck opening 14 for the full length of the robe portion 12 intermediate the sleeves 16. Suitable tie strings 22,24 are provided at opposite sides of the opening 20 to secure the gown 10 in place once properly positioned on the wearer's body. A pair of annular cuffs 26 are sewn or otherwise secured to the respective free ends of the sleeves 16 to surround the wrist openings 18.

Preferably, the robe portion 12 of the gown 10 is fabricated of a sufficiently inexpensive material to be disposable, e.g., a conventional non-woven textile material, whereby the gown 10 may be discarded after only a single use or possible a limited number of uses. The cuffs 26 are fabricated of a knitted construction, preferably circularly knitted and elasticized, so as to conform closely to the wearer's wrists.

Figure 2:
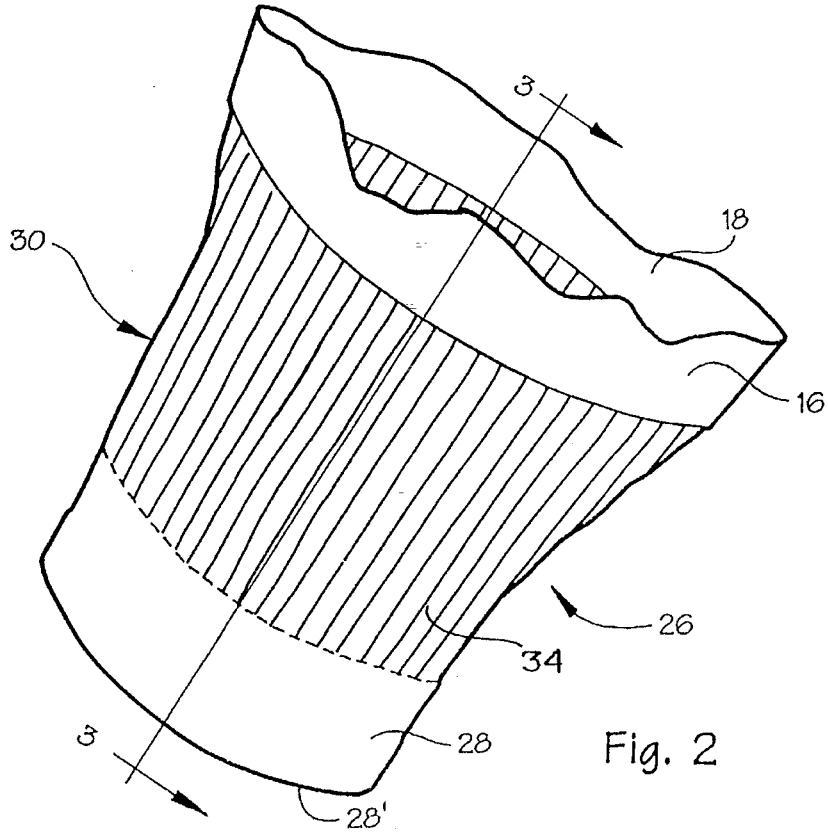
FIG. 2 is an enlarged perspective view of one cuff of the surgical gown of FIG. 1.
Figure 3:
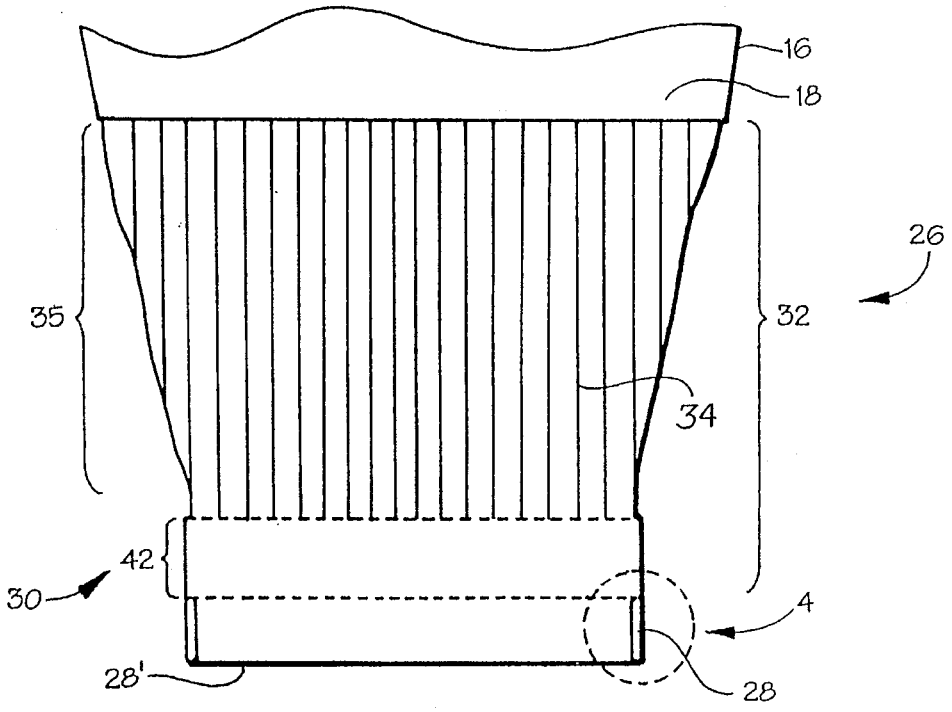
FIG. 3 is an axial cross-sectional view of the cuff of FIG. 2, taken along line 3—3 thereof.
Figure 4:
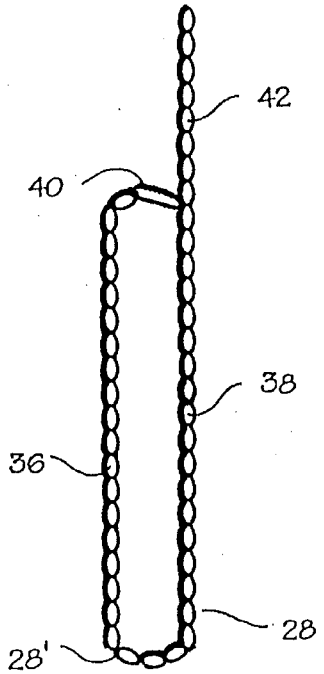
FIG. 4 is an enlarged cross-sectional view of the turned welt forming the finished outer edge of the cuff of FIG. 3.

As best seen in FIGS. 2–4, the cuffs 26 are predominantly of a single-ply circularly-knitted construction for economical conservation of materials, with a small two-ply annular welt 28 at the outer axial end of the cuff to form a finished cuff edge 28'. More particularly, each cuff 26 is formed as a circularly-knitted fabric tube, generally indicated at 30 in FIGS. 2 and 3, having a main cuff body portion 32 entirely of a single-ply knitted construction integrally knitted at its outer end with the two-ply turned welt 28.

Each cuff 26 is of a suitable axial length for use as a wrist cuff, preferably approximately three and three-quarters inches, of which the turned welt occupies less than approximately one-half inch of the overall cuff length. Each cuff 26 is tapered diametrically along its length, the turned welt 28 being of the smallest diametric dimension, preferably approximately two and one-half inches, and the main cuff body portion 32 having an increasing diametric dimension axially away from the turned welt 28, preferably reaching a diameter of approximately four inches at the opposite axial end of the cuff 26. The predominant length 35 of the main cuff body portion 32 is knitted with a ribbed stitch construction forming a plurality of circumferentially-spaced axially-extending ribs indicated at 34.

As best seen in FIG. 4, the turned welt 28 includes an inner ply 36 and an outer ply 38 formed of a continuous extent of circularly-knitted fabric axially folded intermediately along its length to form the finished edge 28', with the opposite ends of the inner and outer plies 36,38 being integrally knitted with one another by connecting stitches, representatively indicated at 40, spaced circumferentially about the cuff 26 and with the outer ply 38 being integrally knitted also with the main cuff body portion 32.

The annular region 42 of the main cuff body portion 32 immediately adjacent and directly knitted integrally with the outer ply 38 of the turned welt 28 generally follows the same stitch construction of the turned welt 28 for a relatively short axial extent of the cuff 26, e.g., approximately one-half inch, and then merges integrally into the predominant ribbed region 35 of the main cuff body portion 32.

Figure 5:
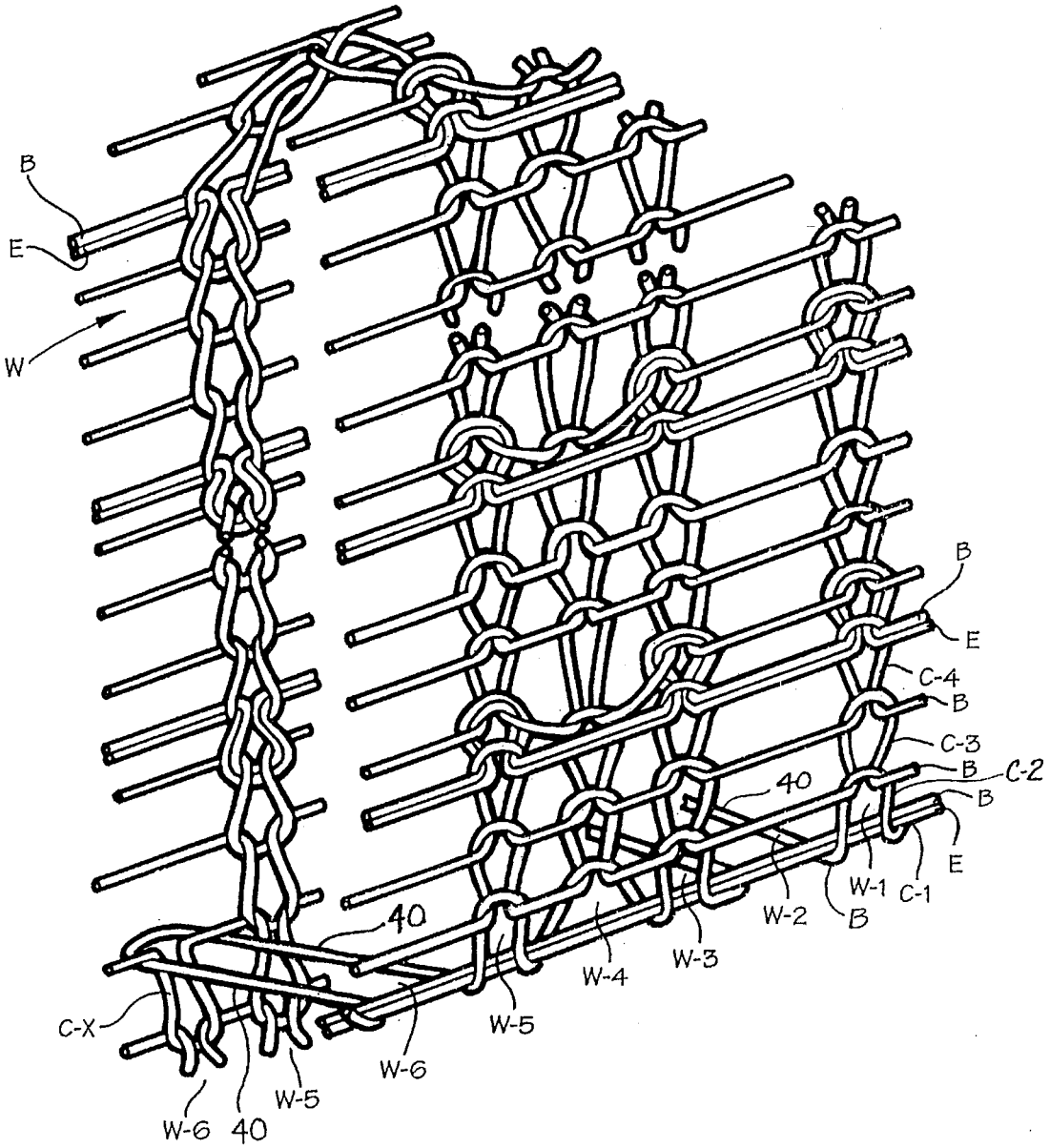
FIG. 5 is a substantially enlarged, somewhat schematic diagram of the stitch construction of the turned welt of FIG. 4.
Figure 6:
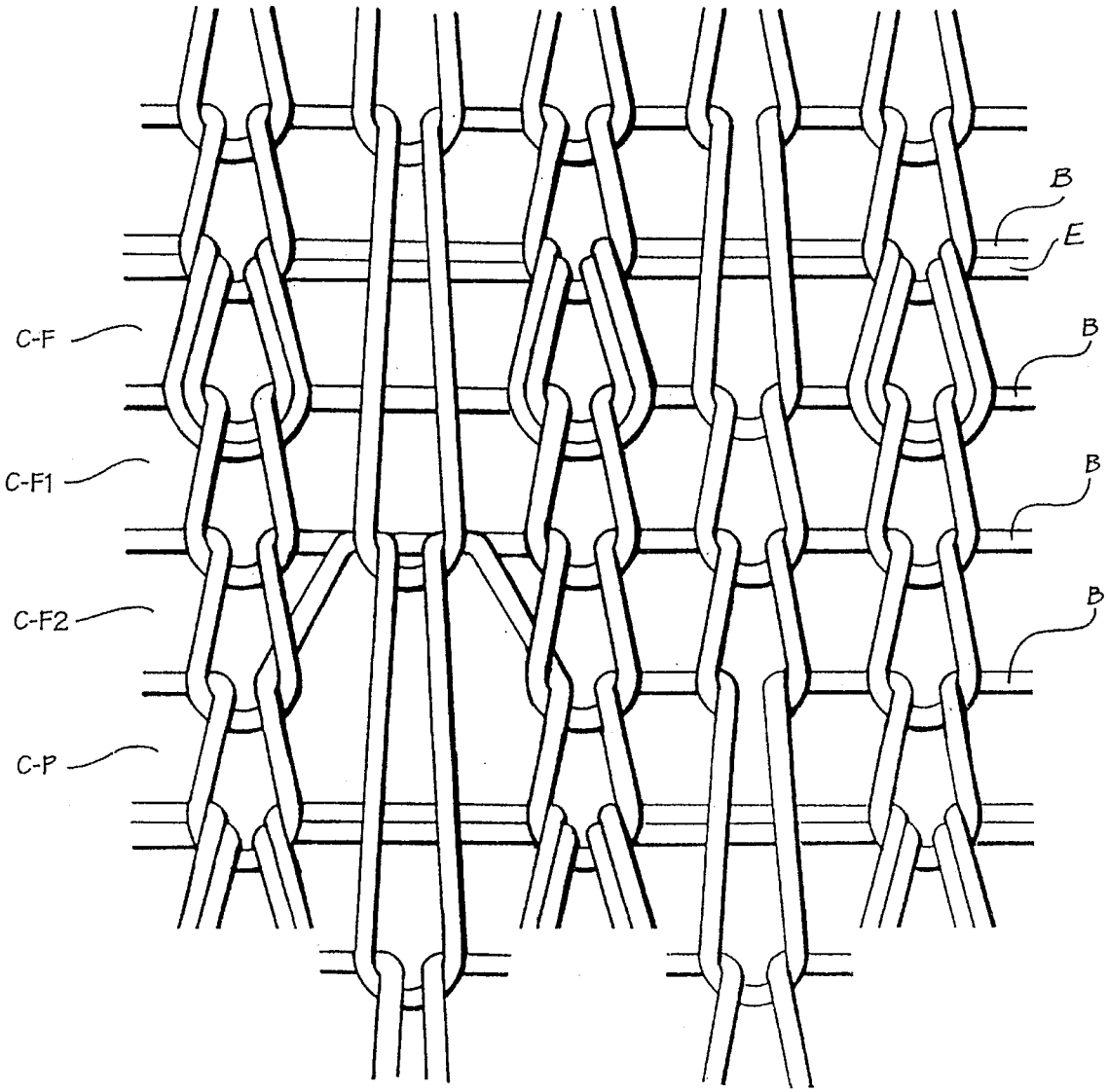
FIG. 6 is a substantially enlarged, somewhat schematic diagram of the stitch construction of one region of the single-ply main cuff body portion of the cuff of FIGS. 2 and 3.
Figure 7:
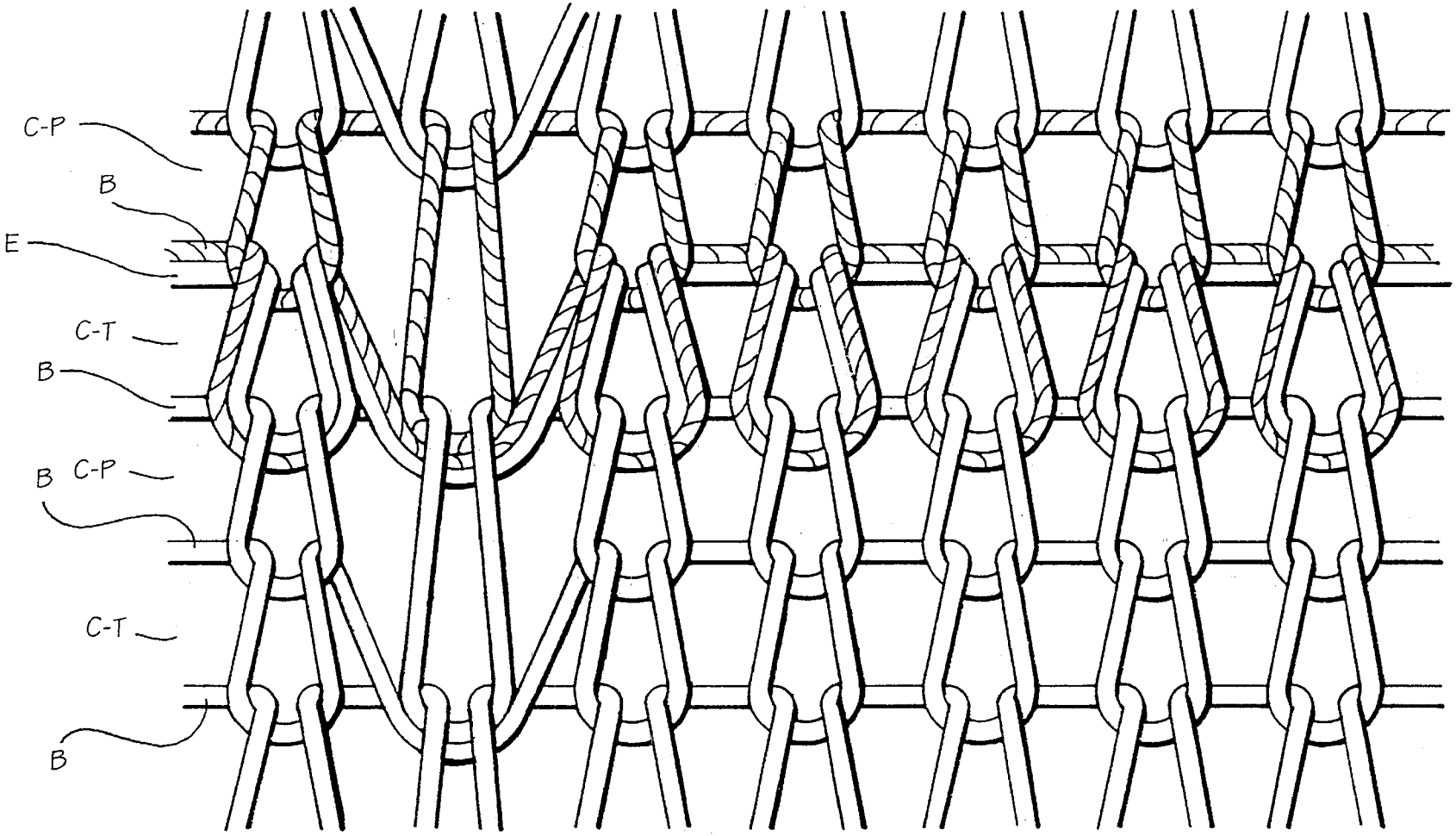
FIG. 7 is a similar substantially enlarged schematic diagram of the stitch construction of another region of the single-ply main cuff body portion of the cuff of FIGS. 2 and 3.

The particular knitted stitch construction of the cuff 26 and the knitting method by which it is formed may best be understood with reference to FIGS. 5–7. Each knitted cuff 26 is preferably formed on a circular hosiery knitting machine which may be of a variety of suitable single or multi-feed types commonly known within the knitting industry, although a multi-feed machine is preferred. Such knitting machines basically include a rotatable needle cylinder of a relatively small diameter with axial needle slots formed in spaced relation to one another about the outer circumferential surface of the cylinder. A plurality of latch-type knitting needles, each having a yarn receiving hook and a closable latch assembly, are reciprocably disposed within the axial cylinder slots. Preferably, the knitting machine has four knitting stations at which yarn feeding fingers or other feeding instruments are positioned for movement into and out of yarn feeding disposition adjacent the upper end of the needle cylinder to feed yarn to the needles thereat. The needles are operatively manipulated within their respective slots of the cylinder by stationary cams positioned adjacent the cylinder to engage and act on cam butts formed on the needles during the rotation of the needle cylinder. The knitting machine is operable to carry out the knitting of each cuff 26 beginning with the turned welt 28 and continuing therefrom through the main cuff body portion 32. An appropriate control drum or similar control arrangement of a conventional construction is provided on the machine for determining the necessary transitional changes in the machine operation to form each portion of the cuff 26.

For the knitting of the cuffs 26 in accordance with the preferred embodiment of the present invention, the knitting machine is initially set up with one yarn feeding finger at each of the four knitting stations of the machine equipped with an appropriate body yarn, e.g., a texturized multifilament polyester or nylon yarn, suitable for forming the main fabric structure of the cuff. In addition, a designated one of the knitting stations is set up with another of its yarn feeding fingers equipped with an uncovered elastomer filamentary yarn to be fed to the needles simultaneously with the body yarn at such knitting station.

As will be understood, the needle and yarn manipulations carried out by the circular knitting machine serves to stitch the yarns fed to the needles at the various knitting stations into successive needle loops which extend in the resultant fabric in circumferentially-extending courses of needle loops and axially-extending wales of needle loops.

The initial knitting of the turned welt 28 at the beginning of the knitting process and the resultant stitch construction is shown in FIG. 5. To begin the knitting of a cuff 26, the knitting station having both elastic and body yarns is activated to feed the yarns simultaneously to every other needle in the needle cylinder so that the yarns are interlaced alternately in front of and behind the succeeding needles to form an initial fabric course C-1 of the elastic and body yarns E,B, respectively, which will serve as a so-called "makeup" selvage edge. At the next succeeding knitting station, another body yarn B, preferably identical to that of the first knitting station, is fed to every needle of the knitting machine to form a second fabric course C-2 wherein the successive needle loops thereof are drawn alternately to opposite sides of the elastic and body yarns E,B of course C-1. At the next succeeding knitting station, i.e., the third station of the machine, a third body yarn B, again preferably identical to the other body yarns B, is fed in a so-called three-by-one fashion to three of every four successive needles in the cylinder to form a third course C-3 having a repeating pattern of three successive needle loops in three succeeding fabric wales (e.g., wales W-3, W-4, W-5) followed by a single wale float in the intervening fabric wales (e.g., wales W-2, W-6) of the body yarn B. The fourth knitting station feeds its body yarn B, also preferably identical to the other body yarns B, in the identical three-by-one manner as the third knitting station, thereby forming an identical succeeding course C-4.

Having completed one full revolution of the needle cylinder, the cylinder begins its second revolution with the first knitting station again feeding its elastic and body yarns E,B simultaneously to every other needle, thereby shedding the initial makeup course C-1 and this time forming the elastic and body yarns E,B in plated needle loops in every other fabric wale (e.g., wales W-1, W-3, W-5, et seq.) and single wale floats in every intervening wale (e.g., wales W-2, W-4, W-6, et seq.). At the second knitting station, however, the control arrangement of the knitting machine changes the needle manipulation so that the yarn feeding finger and the needles cooperate to stitch needle loops in the same three-by-one manner as previously performed at the third and fourth knitting stations. In this manner, every fourth needle remains inactivated and thereby these needles continue to hold the needle loops of the body yarn B previously formed at the second knitting station during the first cylinder revolution. The operation of the third and fourth knitting stations remains unchanged.

During the third and each succeeding needle revolution of the needle cylinder for a predetermined number of cylinder revolutions sufficient to form the welt 28, the knitting operation performed at the four knitting stations of the machine during the second machine revolution is repeated successively, whereby every fourth needle of the cylinder continues throughout to hold the needle loops formed thereon at the second knitting station during the first cylinder revolution. After completion of the predetermined number of cylinder revolutions has knitted a sufficient number of succeeding fabric courses to form the welt 28, the machine's control arrangement again alters the needle manipulation at the second knitting station to activate every needle thereat during one selected cylinder revolution, thereby forming a plain-knit fabric course C-X and casting-off therefrom the needle loops previously held on such needles, which needle loops thereby form the connecting stitches 40 and, in turn, complete the formation of the turned welt 28.

For a predetermined number of succeeding revolutions of the needle cylinder thereafter, the second knitting station is returned to the three-by-one manner of knitting operation followed during the previous formation of the welt 28, while the operation of the fourth knitting station is altered to activate every needle to form plain-knit courses. The knitting operation at the first and third knitting stations remains unchanged. In this manner, the annular region 42 of the cuff 26 is knitted integrally with the outer ply 38 of the welt 28 in essentially the same knit construction as the welt 28, excepting only that the courses formed by the fourth knitting station are of a plain knit rather than a three-by-one knit/float construction. The knitted construction of the annular region 42 thusly formed is depicted in FIG. 6 wherein course C-F represents the one-by-one knit/float construction formed at the first knitting station, courses C-F1 and C-F2 represent the knitted construction formed by the three-by-one knit/float operation of the second and third knitting stations, and course C-P represents the plain-knit construction formed by the operation of the fourth knitting station.

Upon completion of knitting of the annular region 42 of the cuff 26, the knitting operation at the first, second and third stations is changed to produce the ribbed construction of the annular region 35. Specifically, the first and third knitting stations are altered to operate in a so-called one-by-seven tuck/knit manner wherein every eighth needle in the cylinder is activated only to a tuck position sufficient to receive a newly-fed yarn but not to cast off a held previously-formed needle loop, while the seven succeeding intervening needles are fully activated to a knit position, thereby forming courses having seven succeeding needle loops alternating with single-wale intervening tuck stitches, as represented by courses C-T in FIG. 7. The operation of the second knitting station is altered to activate all cylinder needles thereat so as to form plain-knit courses, while the fourth knitting station continues to operate in such manner, as represented by courses C-P in FIG. 7. This manner of operation of the knitting machine continues for a sufficient number of cylinder revolutions (substantially greater in number than during the formation of the welt 28 and the annular region 42) to fabricate the remaining axial length of the cuff 26. As will be understood, the tuck stitches alternating every eighth wale in the resultantly knitted fabric produce the axial ribs 34 through the annular fabric region 35.

Upon completion of knitting of the ribbed fabric region 35, the first and third knitting stations are deactivated and the second and fourth knitting stations are converted to knit in a one-by-one knit/tuck manner for a small number of final cylinder revolutions, after which the feed fingers at every knitting station are deactivated and the cuff 26 is thereby cast off the needles of the cylinder during the next succeeding revolution. The knitting machine then immediately begins the entire knitting process once again to begin the formation of another knitted cuff 26.

As will be readily understood by those persons skilled in the art, knitted cuffs can be fabricated in a variety of other knitted constructions than the specific construction described above, using a variety of other alternative forms of knitting machines, for example but without limitation, knitting machines having a greater or fewer number of knitting stations and yarn feed fingers and knitting machines having a dial with reciprocable dial transfer jacks or other dial elements for use in forming the turned welt. Likewise, various additional or alternative yarns could be utilized, including additional elastic yarns. It has however been found to be preferable to utilize yarns having opposing S and Z twists to counteract one another and, in turn, cooperate in imposing a flattening effect on the knitted fabric. For example, as representatively shown in FIG. 7, in the embodiment just described, it is preferred that the body yarns fed at the first and third knitting stations have an opposing twist to the body yarns fed at the second and fourth knitting stations, whereby the torque of the yarns counteract one another to flatten the tubular fabric.

Advantageously, the knitted cuffs 26 produced by the present invention in the manner above-described uniquely enable the methodology by which surgical gowns are fabricated to be streamlined so as to reduce not only material costs but also fabrication time and labor costs. As previously described, conventional cuffs are formed from a continuously knitted length of a rib-type circularly-knitted fabric by initially cutting a desired length of the fabric, folding it axially into a double-ply configuration to form a finished edge at the fold location, and then sewing the two plies at the opposite end of the folded fabric to the sleeve of a surgical gown. This procedure disadvantageously necessitates the laborious and time-consuming post-knitting steps of cutting and folding the fabric preparatory to sewing, which of course adds to the overall cost of the surgical garment.

In substantial contrast, as will be understood from the foregoing description, the cuffs 26 in accordance with the present invention are knitted and cast off the circular knitting machine in the form of discrete individual cuffs blanks which are ready without any cutting, folding or other structural modification for immediate sewing into a surgical gown or other garment. Accordingly, cuff blanks fabricated in accordance with the present invention eliminate two labor-intensive steps from conventional fabrication methods and, in turn, eliminate the work-in-process inventory and storage requirements attendant to such intermediary steps. Of course, of equal significance is the advantage that the present cuff significantly reduces material costs by providing a one-ply cuff in replacement of the conventional two-ply cuff.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A protective body garment to be worn by surgical and other medical personnel comprising a main body for covering a portion of a wearer's body, an opening in the main body for extension therethrough of an extremity of the wearer's body, and an annular cuff affixed to the main body in surrounding relation to the opening for conforming to the wearer's extremity, the cuff comprising a circularly-knitted fabric tube having a main cuff body portion affixed to the main body and extending therefrom to and terminating at an outer end of the cuff in an integral turned welt forming a finished cuff edge, the main cuff body portion being entirely of a single ply knitted construction.

2. A protective medical body garment according to claim 1 wherein the garment comprises a gown having a pair of sleeves each terminating in a wrist opening and a pair of the cuffs each affixed to a respective one of the sleeves surrounding its wrist opening.

3. A protective medical body garment according to claim 1 wherein the circularly-knitted fabric tube of the cuff includes an elastic yarn.

4. A protective medical body garment according to claim 1 wherein the turned welt of the cuff is of a lesser diameter than the main cuff body portion to form the cuff of a tapered configuration.

5. A protective medical body garment according to claim 1 wherein the main cuff body portion is formed with a plurality of circumferentially-spaced axially-extending ribs.

6. A protective medical body garment according to claim 1 wherein the main cuff body portion comprises at least one S-twist yarn and at least one Z-twist yarn to cooperatively provide a flattening effect on the fabric tube.

7. A protective medical body garment according to claim 1 wherein the circularly-knitted fabric tube comprises at least one yarn formed in needle loops extending in circumferential courses and axial wales, the turned welt comprising a welt beginning course, a welt ending course, and a plurality of intervening courses, the welt beginning and welt ending courses being connected with one another by a set of connecting needle loops formed in selected spaced wales, and the intervening courses comprising needle loops formed only in wales other than the selected spaced wales.

8. A protective medical body garment according to claim 7 wherein each intervening course comprises yarn floats across the selected spaced wales.

9. A protective medical body garment according to claim 8 wherein the selected spaced wales comprise every fourth wale of the fabric tube.

10. A protective medical body garment according to claim 8 wherein the main cuff body portion comprises selected courses having needle loops formed in every wale.

11. A protective medical body garment according to claim 10 wherein the main cuff body portion comprises a first annular region adjacent the turned welt having courses formed of alternating needle loops and yarn floats and courses formed entirely of successive needle loops, and a second annular region adjacent the first annular region having courses formed of alternating needle loops and tuck stitches and courses formed entirely of successive needle loops.

12. A protective medical body garment according to claim 8 wherein alternating courses of the circularly-knitted fabric tube are formed of an S-twist yarn and intervening courses of the circularly-knitted fabric tube are formed of a Z-twist yarn to cooperatively provide a flattening effect on the fabric tube.

13. A surgical gown for wearing by surgical and medical personnel as a protective body garment comprising a main body robe portion for covering the wearer's torso and arms, the robe portion having a pair of arm sleeves terminating at wrist openings therein for extension respectively therethrough of the wearer's arms, and a pair of annular cuffs each affixed to a respective one of the sleeves in surrounding relation to the respective wrist opening thereof for conforming to the wearer's wrists, each cuff comprising a circularly-knitted fabric tube having a main cuff body portion of a single ply knitted construction terminating at an outer end of the cuff in an integral turned welt forming a finished cuff edge, the circularly-knitted fabric tube of each cuff comprising a plurality of body yarns and an elastic yarn formed in needle loops extending in circumferential courses and axial wales, the turned welt of each cuff comprising a welt beginning course, a welt ending course, and a plurality of intervening courses, the welt beginning and ending courses being connected with one another by a set of connecting needle loops formed in selected spaced wales and the intervening courses comprising needle loops formed only in wales other than the selected spaced wales and yarn floats across the selected spaced wales, the main cuff body portion of each cuff comprising a first annular region adjacent the turned welt having courses formed of alternating needle loops and yarn floats and courses formed entirely of successive needle loops appearing in every wale and a second annular region adjacent the first annular region having courses formed of alternating needle loops and tuck stitches and courses formed entirely of successive needle loops appearing in every wale.

14. A surgical gown according to claim 13 wherein alternating courses of the circularly-knitted fabric tube are formed of an S-twist yarn and intervening courses of the circularly-knitted fabric tube are formed of a Z-twist yarn to cooperatively provide a flattening effect on the fabric tube.

* * * * *